US005240569A

United States Patent [19]

Waldron

[11] Patent Number: 5,240,569

[45] Date of Patent: Aug. 31, 1993

[54] MAGNETICALLY ENHANCED ELECTROLYSIS CELL SYSTEM

[75] Inventor: Robert D. Waldron, Hacienda Heights, Calif.

[73] Assignee: Rockwell International Corporation, Seal Beach, Calif.

[21] Appl. No.: 767,438

[22] Filed: Sep. 30, 1991

[51] Int. Cl.[5] ..... C25B 15/00; C25C 3/00; C25C 7/00

[52] U.S. Cl. ..... 204/1.11; 204/237; 204/243 M; 204/244; 204/267; 204/272; 204/DIG. 5

[58] Field of Search ..... 204/DIG. 5, 243 M, 220, 204/244, 267-270, 237, 1.11

[56] References Cited

U.S. PATENT DOCUMENTS

| | | | |
|---|---|---|---|
| 788,506 | 5/1905 | Ashcroft | 204/220 |
| 4,201,635 | 5/1980 | Müller | 204/DIG. 5 |
| 4,469,759 | 9/1984 | Newill | 204/DIG. 5 |
| 4,565,748 | 1/1986 | Dahl | 204/DIG. 5 |

*Primary Examiner*—Donald R. Valentine
*Attorney, Agent, or Firm*—Lawrence N. Ginsberg; Charles T. Silberberg

[57] ABSTRACT

The system includes at least one electrolysis cell having a principal direction of current flow. The electrolysis cell has two electrode surfaces whose mean surface planes are substantially parallel, separated by a fluid electrolyte layer.

Separate electric current conducting means, energized by an electric power source and independent of the electrolysis circuit elements are so arranged and constructed with respect to the cell to increase the average component of the magnetic field substantially parallel to the mean electrode surfaces within the fluid electrolyte layer. This increase in the magnetic field is relative to the magnetic field due solely to the electrolysis current. A flow return conduit is included for connecting at least one entrance port of the electrolysis cell to a least one exit port of the electrolysis cell. The ports are disposed substantially parallel to the pressure gradient formed by the magnetic forces present during operation.

11 Claims, 4 Drawing Sheets

NORMALIZED MAGNETIC FIELD STRENGTH VS. RADIUS FOR ANNULAR CELLS

MAGNETICALLY ENHANCED ELECTROLYSIS CELL SYSTEM

BACKGROUND OF THE INVENTION

1. Field of the Invention

The present invention relates to the design and operation of electrolysis cells for chemical production and more particularly to production scale electrolysis cells.

2. Description of the Related Art

High temperature electrolysis cells, such as are used for aluminum reduction are often operated using gravity stabilized liquid layers of molten metal, fused salt, etc. with the electrolysis electric current passing in a vertical direction through a shallow layer of electrolyte solution. For reactions in which gas is evolved in the form of, for example, oxygen bubbles or a deposit of a partially insulating film at an anode, the bubbles or film must be efficiently removed or the electrolyte will be displaced and cell resistance will rise.

For large industrial scale cells operating with currents of $10^5$ amperes and above, the magnetic field developed at the periphery of a large cell is substantial and will induce a lateral force on the electrolyte which can exceed typical buoyant forces on bubbles or low density fluids. This force can be used to displace the electrolyte toward elevated channel regions where gas bubbles may be collected. Auxiliary systems to increase this magnetic field will permit more rapid flow of electrolyte and improve cell operation.

Unfortunately in the usual geometries of circular or rectangular cells, the self-magnetic field vanishes at the geometrical center. The present inventor has been specifically involved with investigating methods for producing oxygen from lunar soil. Operation of such electrolysis cells to produce oxygen on the moon by electrolyzing molten lunar soil or rock will encounter additional difficulties in bubble removal due to lowered buoyant forces with ambient gravity (1/6 earth value) and the higher viscosities of silicate fluids. It was during these investigations that the present inventor discovered the present invention, which, although is particularly adaptable for lunar applications, has broad based general applications.

As will be disclosed below, the present invention is designed to provide a minimum total or combined field of at least 70% of the edge field.

U. S. Pat. No. 4,713,161, issued to Chaffy et al., entitled "Device for Connection Between Very High Intensity Electrolysis Cells for the Production of Aluminum Comprising a Supply Circuit and Independent Circuit for Correcting the Magnetic Field", is based on using a separate predominantly horizontal electric circuit to compensate for the self-field of a line of rectangular cells in series and also to counteract the stray magnetic field due to adjacent lines of cells. The '161 device is intended to reduce the vertical part of the magnetic field in the cell as much as possible to minimize distortion in the molten cathode pool.

U.S. Pat. No. 4,469,759, issued to W. J. Newill, entitled "Magnetic Electrolyte Destratification" and U.S. Pat. 4,565,748, issued to E. A. Dahl, entitled "Magnetically Operated Electrolyte Circulation System" discloses pumping devices which are outside the working portion of the electrolysis cell or cell stack. The magnetic field of the pumping devices disclosed in these patents have negligible penetration into the working portion of the cell or cell stack. The '748 patent uses two-phase AC excitation of the magnetic coils and induced currents in the electrolyte. The '759 device uses DC or a permanent magnetic field and imposes current flow through the electrolyte to achieve a pumping effect. Both of these devices are primarily intended for use in multi-plate batteries rather than electrochemical production cells.

U.S. Pat. No. 3,969,214, issued to M. Harris, entitled "Permanent Magnet Hydrogen Oxygen Generating Cells" discloses the use of thermal energy, only, to produce hydrogen and oxygen from aqueous acids. It uses a combination of permanent magnets and coils to produce a magnetic field substantially at right angles to the electrode faces.

OBJECTS AND SUMMARY OF THE INVENTION

It is therefore a principal object of the present invention to improve the current density and operation of electrolysis cells.

Another object is to promote the bubble removal of electrochemically generated gases on electrodes of these electrolysis cells.

Another object of the present invention is to lower the resistivity of the electrolyte and improve the energy efficiency of the cell.

These and other objects are achieved by the present invention which is a system for increasing laminar or turbulent lateral flow in an electrolysis cell. In its broadest aspects, the system includes at least one electrolysis cell having a principal direction of current flow. The electrolysis cell has two electrode surfaces whose mean surface planes are substantially parallel, separated by a fluid electrolyte layer.

One or both of the electrodes may have local regular or random structures (elevations or depressions above or below their mean surface planes) and in addition may consist of a plurality of smaller structures connected in parallel to the power sources. The electrolysis cell proper may be defined as comprising the electrolyte and container, electrodes and circuit elements essential to the electrochemical process involved.

Separate electric current conducting means, energized by an electric power source and independent of the electrolysis circuit elements are so arranged and constructed with respect to the cell to increase the average component of the magnetic field substantially parallel to the mean electrode surfaces within the fluid electrolyte layer. This increase in the magnetic field is relative to the magnetic field due solely to the electrolysis current. A flow return conduit is included for connecting at least one entrance port of the electrolysis cell to a least one exit port of the electrolysis cell. The ports are disposed substantially parallel to the pressure gradient formed by the magnetic forces present during operation.

The present invention can provide a smooth, shear flow parallel to the mean plane of the electrode surfaces. The shear flow can be adjusted over a considerable range of velocities for electrolysis cells of different sizes. Particularly, a large flow velocity can be achieved in small cell sizes which otherwise would have small magnetic self fields. Depending on the detailed geometry of the electrodes. It is possible to induce vortex flow which may aid in the removal of bubbles and partially insulating films.

In the preferred embodiment, annular electrolysis cells are divided into series connected groups and the current paths are minimized for assemblies within an even number of cell groups. These cell groups can be deployed in a manner which minimizes unwanted stray magnetic fields.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures are designated by the same reference characters.

DETAILED DESCRIPTION OF THE PREFERRED EMBODIMENTS

Figure 1:
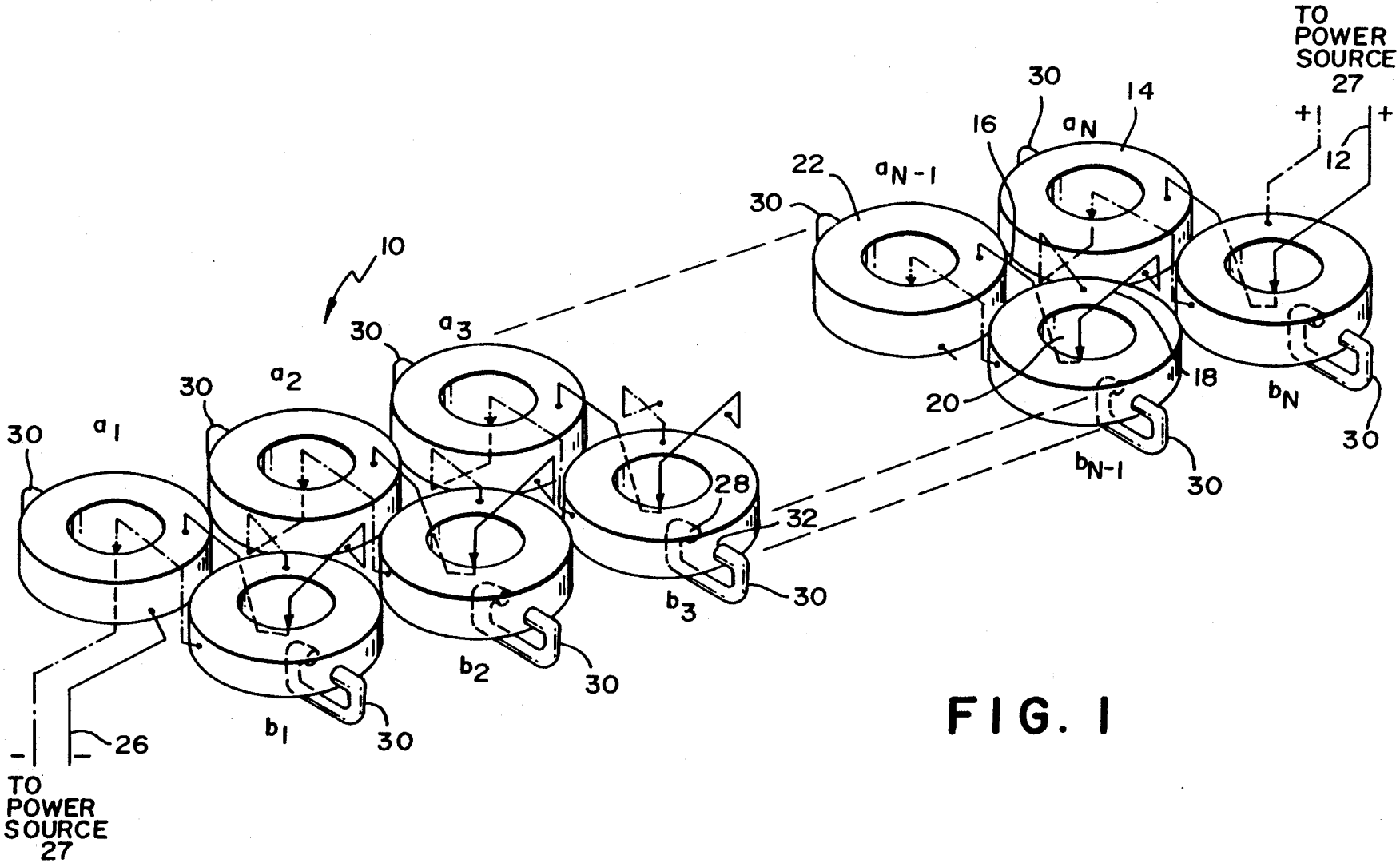
FIG. 1 is a schematic perspective illustration of two groups of interleaved, series connected annular electrolysis cells connected in accordance with the principles of the present invention.

Referring to the drawings and the characters of reference marked thereon, FIG. 1 illustrates a preferred arrangement of electrolysis cells in accordance with the principles of the present invention, designated generally as 10. In a typical commercial plant system, a large number of electrolysis cells are operated in series. FIG. 1 illustrates the present novel connection of electrolysis cells to provide enhanced parallel magnetic fields.

FIG. 1 illustrates two groups of serially connected electrolysis cells, labelled a and b. Each group is preferably deployed in a straight line and the two lines are in close proximity to each other. All of the cells are substantially identical. Each electrolysis cell is annular in horizontal cross section and contains a central aperture. The current flow through the electrolysis cells is vertically downward. The electric current conducting means or conductor 12 contacts the anode 14 of the last cell $a_N$ of the a group of serially connected electrolysis cells. It exits through the bottom electrode or cathode 16 of cell $a_N$. The exiting current is brought up along the electric current conducting means, as shown at location 18, and passes down through the aperture 20 of the adjacent cell of the b group, $b_{N-1}$. Electric current conductor 18 is then directed to the anode 22 of the preceding a-group cell, $a_{N-1}$. This interleaved conducting pattern is continued between each preceding successive cell. The current finally passes through the cathode 24 of the first cell, $a_1$ and passes along conductor 26 to an external power source 27.

The serially connected b-group of electrolysis cells are connected in the same manner as the a-group of cells. Prior to the point where the current enters or leaves its respective chain it must pass through an aperture of the adjacent chain. Thus. for example, prior to the current entering the $a_N$ anode or upper electrode 14 the conductor is first introduced through the aperture in cell $b_N$. In the case of the b chain, the current exiting the cathode or bottom electrode $b_1$ will be brought up and passed downward through the aperture of $a_1$ before being connected to the external power source 27.

The magnetic force between the current carrying electrolyte and the magnetic field is directed radially inward on the fluid and produces a pressure gradient increasing in the radial inward direction. The electrolyte is allowed to recirculate by passing through an exit port 28 on the inner surface of the annulus and flowing through a conduit 30 to an entrance port 32 on the outer periphery of each annular cell. Although for simplicity in the drawing, FIG. 1 shows only one conduit 30 for each cell these conduits might normally be arranged in a series of radial conduits disposed about the circumference of each annular cell.

The current flow arrangement shown in FIG. 1 has the electric current in the cell groups a and b running essentially parallel in the end-to-end flow of the cell groups. An alternative arrangement produced by a slight modification of the wiring diagram would be to arrange for the series flow in cell group b to flow from left to right rather than right to left as shown in the figure. This may be of advantage in a further option where the cell string a and cell string b are connected in series. In that case the current exiting cell string a, for example, on the left hand edge, could be connected to the cell $b_1$ and the current could progress then from $b_1$ to $b_n$. Both the entrance and the exit current from the combined cell stacks would thus be at the right hand edge of the figure.

In conventional static electrolysis the current density is often limited by heating effects. The current density may be limited by chemical diffusion in the electrolyte or by evolution of gaseous bubbles at one or both electrodes and deposition of partially insulating films on the electrodes. The effects of depletion of charge carrying species in vicinity of the electrodes and accumulation of gas bubbles can be reduced or eliminated by accelerating the stirring action in the electrolytic fluid. Insulating films such as those deposited during anodization of metal surfaces may also be favorably influenced by increased stirring action.

The magnetic fields due to the current flowing vertically downward through the electrolytic cells and their apertures produce a circulating circumferential field in the clockwise direction viewing along the direction of current flow. By adjusting the current ratio through the apertures and the cells and the ratio of inside to outside radii or diameters of the annular electrodes, one can produce nearly uniform and elevated levels of magnetic field strength through the volume of the electrolyte (see FIG. 5). The magnetic pressure gradient due to current carrying fluids in a magnetic field is given by the vector product of the current density and magnetic induction. By developing a higher average magnetic field or induction higher pressure drops are developed across the electrolysis cell and increased recirculant flow is produced.

Figure 2:
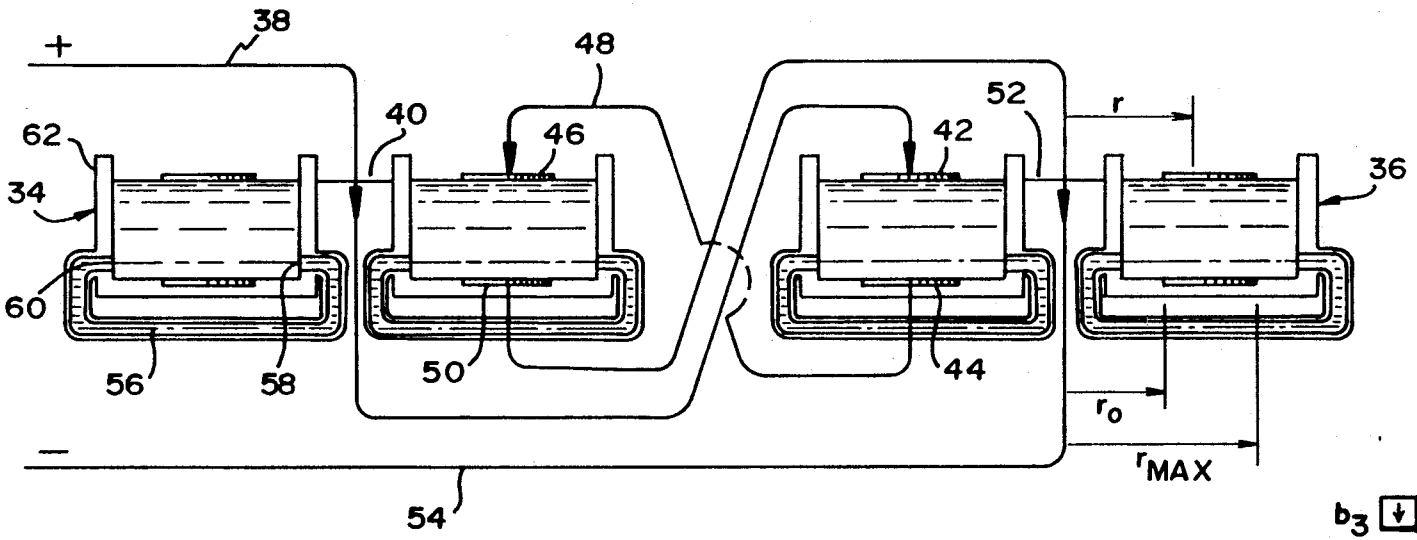
FIG. 2 is an enlarged cross sectional view of two annular electrolysis cells connected in series, illustrating the wiring thereof and the arrangement for recirculant flow.

Referring now to FIG. 2, an alternate embodiment is illustrated showing two electrolysis cells 34, 36 connected in series. The input current lead 38 for the electrolysis cell 36 first passes through the aperture 40 of cell 34. It is then brought up and enters the anode 42 of cell 36. The cathode 44 from cell 36 is connected to the anode 46 of cell 34 via conductor 48. The current emerges from the cathode 50 of cell 34 and is then brought up and directed through the aperture 52 of cell 36. The current is then passed via path 54 to the power source (not shown).

Alternately, path 54 can be deployed in the manner of path 38 on an additional pair of electrolysis cells and the current pattern repeated for any even number of cells. The apparatus for allowing the recirculant flow of the electrolyte is shown in the figure as conduit 56. The electrolyte fluid flows out exit port 58 through the conduit 56 and enters the entrance port 60 at the outer periphery of the electrolysis cell. The fluid in the conduit does not experience any sizable pressure gradient since it is carrying a negligible current level, even though the magnetic field may be appreciable at that point.

The conduit may be located within the insulated space for high temperature cells to avoid congealing or freezing the electrolyte (not shown). The electrolysis cell is shown with an electrolyte area or volume larger than that between the electrodes. This can allow for additional fluid inventory or permit temperature differentials to allow the electrolyte to freeze up in certain zones to protect the cell walls 62 against corrosion.

In the arrangement shown, in which current passing through aperture is the same value as the current passing through the cell, there is a unique ratio of outside radius to inside radius of the electrode zones which will provide more nearly uniform magnetic fields across the electrolyte between the electrodes. This radius ratio would be 2 to 1, that is the outside radius of the electrode $r_{max}$ would be twice that of the inside radius $r_o$ of the electrode in the cell.

In the above mentioned embodiments, the electric current conducting means are energized by the same electrical power source, providing current to the electrolysis cells. In a second class of embodiments which incorporate the principles of the present invention, an electric power source is utilized which is independent from the source which provides the electrolysis current for the electrolysis cells. In this class of systems it is usually advantageous to use multi-turn coils to reduce the current values and conductor sizes.

Figure 3:
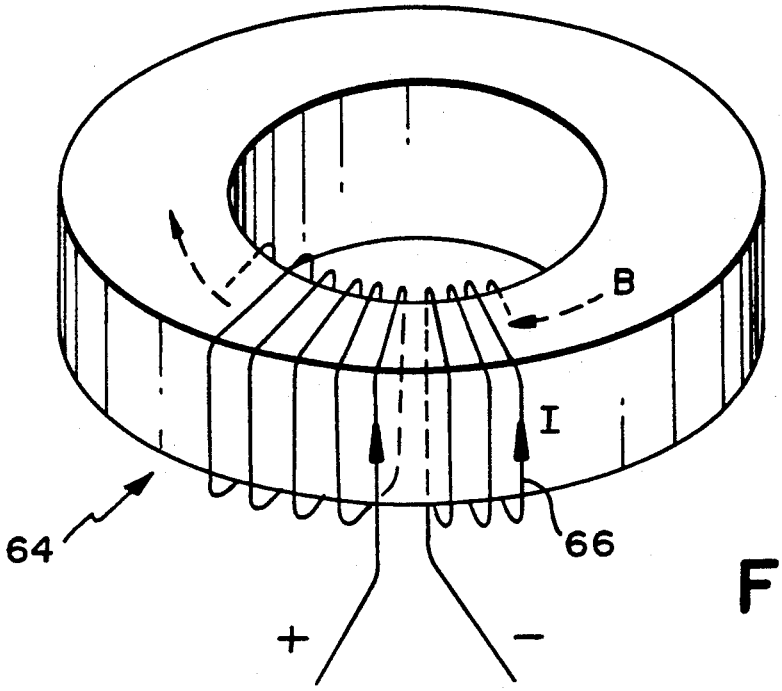
FIG. 3 illustrates an annular electrolysis cell with a toroidal coil used to enhance the magnetic field.

Referring now to FIG. 3, an annular electrolysis cell 64 is illustrated surrounded by a multi-turn radial toroidal coil 66. The direction of current flow is selected to provide a magnetic field in the same direction as the field due to the electrolysis current. With this arrangement it is possible to elevate the magnetic field to a value many times that of the field of the cell electrolysis current. This is particularly useful with small electrolysis cells. Coils 66 may be thermally insulated and constructed of superconducting materials to provide high magnetic fields without power consumption.

Figure 4:
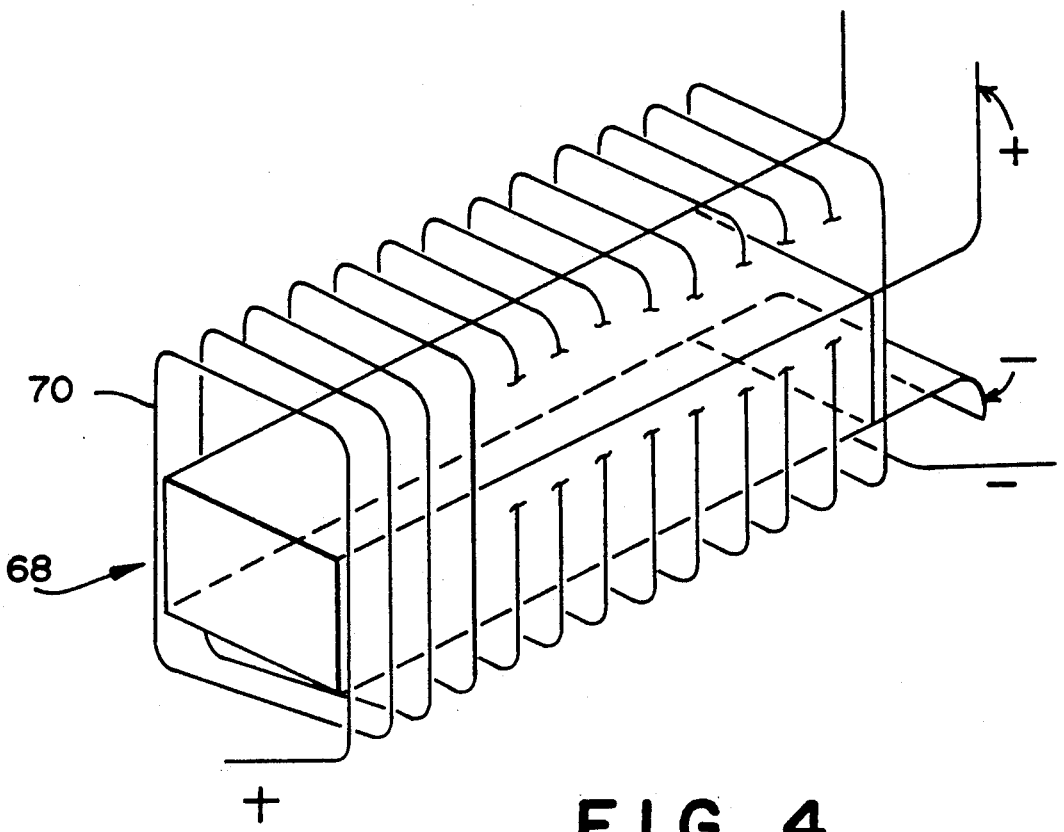
FIG. 4 illustrates a rectangular electrolysis cell with an enclosing rectangular solenoidal coil.

Referring now to FIG. 4 an embodiment is illustrated for a rectangular cell profile in which, as in FIG. 3, the electrical source is independent of the source which provides the electrolysis current for the electrolysis cell. An electrolysis cell 68 having a substantially rectangular cross section is enclosed by a multi-turn rectangular solenoidal coil 70. This, like the FIG. 3 embodiment allows generation of magnetic fields much higher than the field due to cell electrolysis current. The embodiments of this class, which uses multi-turn coils for the electric current conducting means can be energized in series for a large group of cells to reduce the current requirements and improve the engineering advantages of high voltage and low current supplies. In cases where the coils are made of superconducting material it is preferable to energize the persistent current separately for each cell so that in the event of over temperature occurring someplace in the circuits, this would not terminate the stirring system for all the cells at once. The coils could then be separately energized and separately turned on or off during cell operation. For rectangular cell geometry, it is also possible to have a single solenoid coil enclose two or more electrolysis cells either axially or laterally, or conversely, to use several smaller solenoids to enclose a single electrolysis cell.

Figure 5:
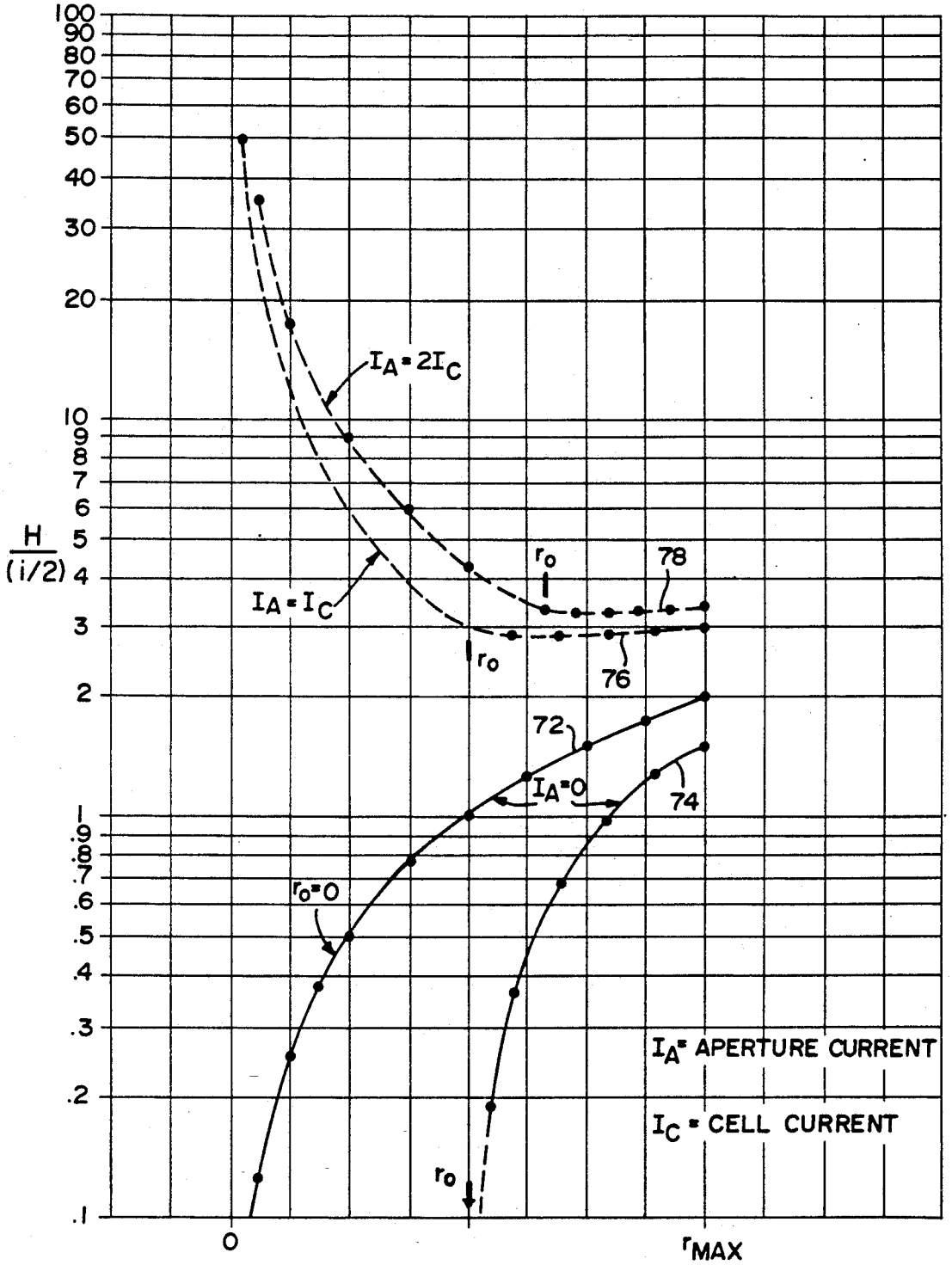
FIG. 5 is a plot of the normalized magnetic field strength versus radius for various annular electrolysis cells with different values of aperture current and radius ratios.

Referring now to FIG. 5, a plot of normalized magnetic field strength versus radius is shown for several of the above-described annular electrolysis cells. The ordinate axis (y) shows the normalized magnetic field strength as a function of the radius from the center of symmetry for circular annular cells displayed on the abscissa or x-axis.

Curve 72 shows how the magnetic field decays from the right hand edge where the outer radius of the electrode down toward the center for the case where the inner aperture drops to zero, that is the case of a solid circular cylinder conductor. The field vanishes where the radius equals zero and reaches a maximum of 2 on the normalized scale. If that same circular conductor is modified by introducing an aperture to form a hollow conductor where the inside radius of the electrode is half the outside radius and operated at the same current density as the original conductor, the maximum field at the outside or right hand edge drops to 75% of the maximum value of curve 72 (i.e. 1.5), as illustrated by curve 74. Note that curve 74 refers to the case where there is no extra current flowing through the aperture and the magnetic field drops to zero at the inside radius. For the same annular cell with the inside to outside electrode radius ratio of 1 to 2 the magnetic field is shown in curve 76 where the extra electric current passing through the aperture is equal to the current passing through the cell, characteristic of the embodiments which use the same cell current source for the electric current conducting means. Note that the magnetic field is increased from curve 74 to 76 and furthermore that the magnetic field is very nearly uniform within 5% across the electrolyte within the electrode areas. Inside the aperture, the magnetic field, as shown in the dotted line, increases to a minimum radius depending on the radius of the central conductor, but this is of no consequence in the operation of the cell.

Curve 78 shows the corresponding case where the current passing through the internal aperture is twice the current passing through the cell as one might obtain from using three groups of cells which are interleaved. In this case, if one selects the inner radius of electrode area to be $\frac{2}{3}$ of the outer radius one will obtain a nearly uniform magnetic field across the cell. Again, the magnetic field within the annulus that is not in the electrolyte area is shown increasing as the distance from the central axis is decreased.

For the earlier case shown in curve 76, the average magnetic field and average pressure gradient across the cell from the outside to inside edge is approximately 4 times higher than that shown in curve 74, which is the annulus without the central aperture current. This indicates that the total pressure drop from the inside to the outside edge is 4 times as large as for the case where no aperture current is used. This translates into about 4 times as high a recirculant flow rate through a given conduit system.

Figure 6:
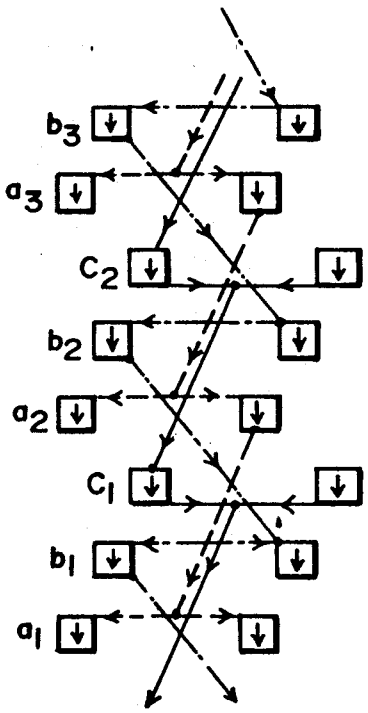
FIG. 6 illustrates a wiring schematic for three series connected cell groups which provide an aperture current equal to twice the cell current.

Referring now to FIG. 6, a wiring schematic is illustrated which corresponds to the curve 78 in FIG. 5. For this case the aperture current is equal to twice the current through an individual cell provided by using 3 groups of cells in series and interleaving the conductors. For example the groups b and c conductors pass through the a cell aperture and conductors for the a and c group cells pass through the b cell apertures and the a and b group cell conductors pass through the apertures of the c cells.

It is understood that the magnetic fields, due to the portions of the circuit which do not pass through the aperture, can be deployed in such a fashion to minimize the stray vertical magnetic fields or the non-uniformity of the horizontal fields by making such current carriers more nearly symmetrical with respect to the axis of the cells. This can minimize adverse effects due to the uneven or unwanted magnetic fields of the system.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A system for increasing lateral laminar or turbulent flow in an electrolysis cell comprising:

a) at least one electrolysis cell having a principal direction of current flow, said electrolysis cell having two electrodes whose mean surface planes are deployed substantially parallel to each other and separated by a fluid electrolyte layer;

b) electric current conducting means energized by an electric power source, said electric current conducting means being so arranged and constructed to increase the average component of the magnetic field, within said fluid electrolyte layer, substantially parallel to said electrode surface planes said increase in the magnetic field being that compared to the magnetic field due solely to the electrolysis current; and c) a flow return conduit connecting at least one entrance port of said electrolysis cell to at least one exit port of said electrolysis cell, said ports being disposed substantially parallel to a pressure gradient developed by the magnetic forces generated during operation.

2. The system of claim 1 wherein said electric power source comprises the same source which provides the electrolysis current for said at least one electrolysis cell.

3. The system of claim 2 wherein a plurality of said electrolysis cells are connected in series.

4. The system of claim 2 wherein the surfaces of said electrodes are substantially annular the electric current conducting means passing through the central aperture of the annulus, the electric current conducting means current flowing in the same direction as the electrolysis current.

5. The system of claim 5 wherein a plurality of cells are divided into two or more groups, each group connected in series and the electric current conducting means of each group carrying the electrolysis current of at least one of the other groups.

6. The system of claim 6 wherein said series connected groups are also connected in series.

7. The system of claim 1 wherein said electric power source comprises a source which is independent from the source which provides the electrolysis current for said at least ne electrolysis cell.

8. The system of claim 4 wherein the surfaces of said electrodes are substantially annular and the electric current conducting means is deployed as a multi-turn radial toroidal coil enclosing the annular electrolysis cell.

9. The system of claim 4 wherein said electric current conducting means form a multi-turn rectangular solenoidal coil enclosing a substantially rectangular electrolysis cell.

10. The system of claim 4 wherein said electric current conducting means includes superconducting coils to provide magnetic fields substantially free of power loss.

11. A method of increasing stirring of electrolytes in electrolysis cells, comprising:

passing electric currents through suitably disposed auxiliary electric circuits independent of the circuit elements of the electrolysis cell proper, shere in the magnetic fields due to currents in said auxiliary circuits combine with and increase the average strength of magnetic fields present in the electrolyte contained within the active volume of the electrolysis cell relative to the magnetic field strengths due solely to electrolysis currents.

* * * * *